United States Patent [19]

Kirby

[11] 4,351,874

[45] Sep. 28, 1982

[54] LOW PERMEABILITY DRYER FABRIC

[75] Inventor: Garry E. Kirby, Marietta, Ga.

[73] Assignee: JWI, Ltd., Montreal, Canada

[21] Appl. No.: 133,433

[22] Filed: Mar. 24, 1980

[51] Int. Cl.[3] ..... D03D 3/00

[52] U.S. Cl. ..... 428/229; 28/146; 28/158; 139/383 A; 139/425 A; 428/244; 428/257; 428/397

[58] Field of Search ..... 428/257, 258, 259, 225, 428/229, 212, 213, 397, 244; 28/142, 158; 139/383 A, 425 A; 162/DIG. 1

[56] References Cited

U.S. PATENT DOCUMENTS

| | | | |
|---|---|---|---|
| 4,144,371 | 3/1979 | Oku et al. | 428/255 |
| 4,224,372 | 9/1980 | Romanski | 428/257 |
| 4,290,209 | 9/1981 | Buchanan et al. | 34/123 |

*Primary Examiner*—James J. Bell

*Attorney, Agent, or Firm*—Oblon, Fisher, Spivak, McClelland & Maier

[57] ABSTRACT

A low permeability dryer fabric woven from monofilament plastic polymeric warp strands and weft strands in which at least some of the weft strands exhibit preferential softening under the influence of heat, said strands adapting to conform to mesh interstices and thereby restrict the passage of air through the fabric.

15 Claims, 4 Drawing Figures

LOW PERMEABILITY DRYER FABRIC

BACKGROUND OF THE INVENTION

1. Field of Invention

This invention relates to dryer fabrics as used in the dryer section of a paper making machine and particularly to those fabrics woven of monofilament plastic polymeric warp and weft strands which are nonmoisture-absorptive and thereby easy to keep clean.

Dryer fabrics serve to hold the web of paper which has been formed and partially dried in close contact against the heated surfaces of rotating dryer cylinders to promote more effective heat transfer to the web.

Permeability is an important characteristic of a dryer fabric and is a measure of its air passage capability. A low permeability fabric will resist the passage of air whereas a high permeability fabric will allow freer passage of air and vapor.

2. Description of Prior Art

Generally, dryer fabrics are woven of either natural or synthetic yarns to form a relatively bulky fabric that will have high porosity to enhance removal of moisture from the web of paper. The yarns are woven closely together, usually with approximately 100% warp fill and usually with several layers of weft to form a low permeability fabric which is flexible in the machine direction yet has good dimensional stability.

With the development of synthetic yarn materials these are, for the most part, replacing natural fibers and the use of all monofilament synthetic yarns is favored because the resultant fabric has increased running life, does not shed fiber, does not carry excessive moisture and is easy to keep clean of various foreign substances, such as, sizing agents, clay-like fillers, resins, gums, waxes and pitch which tend to plug the mesh. The monofilament fabrics usually have high permeability.

It is well known that high permeability fabrics can cause "blowing" in the pockets of a dryer section which results in excessive air movement in the pockets and, due to this, excessive fluttering takes place at the edges of the paper web where it is not supported by the dryer fabric between tiers of cylinders in the dryer section. This flutter problem increases with machine speed and a point is reached when it is no longer possible to attain efficient running speeds because sheet flutter, as it is called, becomes violent enough to cause the web to break, particularly in the early stages of drying where the web is wet and weak.

The effect of fabric permeability on dryer pocket ventilation and sheet flutter has been described by Race, Wheeldon et al (Tappi, July 1968, Vol. 51, No. 7) who have shown that air movement in dryer pockets is influenced by permeability of the dryer fabrics and that, as the fabric passes around a dryer cylinder, a layer of air on the inside surface is squeezed through the fabric and joins a layer of air on the outside surface of the fabric. The combined masses of air tend to be thrown outward by centrifugal force thus generating tangential air movement of high velocity which results in a large mass of air moving laterally out of the pockets thereby causing the edges of the paper web to flutter. The experiments of Race, Wheeldon et al have shown that the quantity of air emerging from the pockets, and thus sheet flutter, is increased with machine speed. Also, these experiments have shown that the quantity of air and sheet further is reduced when the permeability of the dryer fabric is reduced. Therefore, in order to attain efficient machine speeds, it is sometimes desirable to use dryer fabrics having low permeability.

Low permeability in monofilament dryer fabrics is conventionally obtained by inserting in the fabric, some filler (weft) yarns which are fluffy or bulked, as described in Canadian Patent No. 861,275, and which restrict the flow of air through the void paths of the fabric. A disadvantage of these "stuffer" yarns, as they are called, is that they are usually bulky staple fiber yarns which render the fabric susceptible to the absorption of moisture in sufficient quantities to re-wet the web of paper as it separates from the dryer fabric.

A further disadvantage of the bulky yarns is that they also tend to pick up and hold the previously mentioned foreign substances which load up the mesh, impairing its function, and making it more difficult to clean.

A still further disadvantage of the bulky yarns is that, composed usually of fine staple fibers, they are low in bending resistance and contribute to reduced resistance of the fabric to distortion in its own plane.

In order to take advantage of the increased running life and ability to remain free of foreign materials possessed by synthetic fabrics woven entirely of monofilament yarns, it is disclosed in copending U.S. Patent application Ser. No. 906,434 (now abandoned in favor of continuation application Ser. No. 140,475) to use flattened monofilament warp strands and at least some monofilament weft or filler yarns in a stuffer position in a layered (duplex) fabric which are either shaped to conform to interstitial mesh passages or malleable to some extent so that they can adapt to conform therewith. Dryer fabrics, according to this copending application, have the advantages of low permeability and low modulus of elasticity and at the same time are nonabsorptive and are easy to clean and keep clean.

SUMMARY OF THE INVENTION

The present invention provides an improvement over the fabric of our copending application in which, in one embodiment, the stuffer strands are more malleable than the regular filler strands at the time they are woven. As is the case with the regular filler strands, when woven, the more malleable stuffer strands deform to within the limit of their malleability and, in so doing, tend to squeeze out and partially fill the accommodating weft passages of the mesh naturally formed by the warp strands so that interstitial voids, and the passage of air through the fabric, are restricted. There is a limit to the softness or malleability of stuffer strands that can be tolerated because they must have sufficient tensile strength to withstand being pulled rapidly through the weaving shed by the shuttle as they are woven and they must also possess sufficient shear strength to withstand the scissors effect of warp strands when the weaving sheds cross over and they are driven into position by the slay of the loom. Thus, the effect of lowering permeability by using stuffer strands which are more malleable than regular filler strands in the fabric is limited and a point is reached at which the integrity of the low permeability fabric is lost when the stuffer strands are destroyed during the weaving process.

It is a feature of the present invention to provide a layer fabric having low permeability in which at least some of the monofilament stuffer strands are composed of a polymeric thermoplastic material which is susceptible to being preferentially softened by heat. In this way the integrity of the fabric is maintained during weaving and the interstitial areas surrounding the stuffer strands can be reduced by a controlled amount during the heat-setting operation when selected heat sensitive stuffer strands may be induced to soften in sections between warp strands and so conform to restrict interstitial voids. The regular filler strands, which are not heat sensitive to the same extent, maintain the integrity of the cloth.

The present invention thus provides an improvement over copending continuation application Ser. No. 140,475 and when used in conjunction with the flattened warp of the copending application, it further reduces the air permeability of the fabric.

The purpose of heat setting a dryer fabric is to stabilize the fabric so that it will neither stretch nor shrink under operating conditions in a paper machine dryer section where it may be subjected to tensile stress up to about 10 lbs. per linear inch of fabric and temperature up to about 300° F. During heat-setting, the fabric in the form of a belt, is installed on a stretching frame comprising two spaced-apart rollers. The fabric is rotated and the rollers moved apart until the fabric is stretched to a tension of about 10 lbs. per linear inch. The stretched fabric is then heated in the range from about 350° F. to about 430° F. Heating is done either by one of the rollers which is heated internally or by passing the fabric under a bank of infra-red heating elements in a shielded reflector.

In order to take advantage of the heat setting procedure to influence monofilament stuffer yarns and reduce permeability according to this invention it is a feature of the invention to choose the selected stuffer yarns from a group of thermoplastic polymers which begin to melt and soften within the temperature range of normal heat-setting; that is, within the range 350° F. to 430° F. Such materials include some nylons, polybutylene terephthalate and other polymeric materials that have a lower melting point than the warp yarns and regular weft yarns of the fabric.

Another feature of the invention, particularly adapted to dryer fabrics that are to be heat-set by infra-red radiation, is to provide stuffer yarns selected from material which is more absorptive of radiant heat and which therefore soften preferentially before the regular weft yarns often. Such materials may be selected from any thermoplastic known to be more heat absorptive or any thermoplastic which may be rendered more heat absorptive by the addition of a blackening agent like carbon black.

A further feature of this invention is that the permeability of the dryer fabric can be controlled within a practical working range and with reasonable accuracy by heat treating under conditions which may be determined experimentally for a given type and concentration of heat sensitive weft. This feature enables the manufacturer of the dryer fabric to meet a prescribed permeability and to maintain uniformity from one dryer fabric to another.

In a laboratory experiment samples of identical 4 shed, 12 repeat pattern duplex dryer fabric, one having standard hydrolysis resistant polyester stuffer yarn and the other having black nylon stuffer yarn were subjected to infra-red heat treatment at two temperature levels and compared. The results are shown in Table I, below.

TABLE I

| | Sample | | | | | |
|---|---|---|---|---|---|---|
| | POLYESTER STUFFER YARN | | | BLACK NYLON STUFFER YARN | | |
| Condition | Mesh | Thickness (ins.) | Air Perm. cfm/sqft. | Mesh | Thickness (ins.) | Air Perm. cfm/sqft. |
| As Woven | 42 × 50 | 0.091 | 440 | 42 × 50 | 0.0875 | 427 |
| Heat-Set at 420° F. | — | 0.082 | 379 | — | 0.074 | 245 |
| Heat-Set at 435° F. | 46 × 51 | 0.079 | 312 | 48 × 51 | 0.072 | 189 |

It will be seen that the fabric with the black nylon stuffer yarn is thinner and its air permeability is greatly reduced. Microscopic examination of the fabric confirmed that the more heat absorptive nylon had partially melted and flowed to conform to mesh interstices, tending to fill some of the voids in the mesh and thus restricting air passages through the mesh. The temperatures shown in Table I are average and were measured by using temperature indicating tabs. The black nylon yarn would become hotter than indicated.

The susceptibility of blackened stuffer yarn to the effect of radiant heat was demonstrated in another laboratory experiment in which identical samples of four-harness duplex dryer fabric, having blackened nylon stuffer yarns, were subjected to infra-red heat setting and to standard oven heat-setting respectively. In comparing the heat-set samples later it was found that the one subjected to radiant heat had a significantly lower air permeability and this is attributed to the fact that the blackened nylon absorbs more infra-red radiation thus becoming hotter and softening to a greater extent.

According to a broad aspect of the present invention there is provided a dryer fabric comprising a plurality of interwoven monofilament plastic polymeric warp and weft strands. At least some of the weft strands are stuffer strands formed of a material that is preferentially softened under the influence of controlled heat during a heat setting treatment and deform to become narrower at crossings of adjacent warp strands and correspondingly bulges between alternate warp strands to reduce the spaces in the interstitial areas formed by surrounding strands thereby lowering the permeability of the fabric.

According to a further broad aspect of the present invention there is provided a method of making a dryer fabric having reduced permeability and having a plurality of warp and weft strands with at least some of the weft strands being stuffer strands. The method comprises the steps of (i) selecting said weft stuffer strands from a material that is preferentially softened and deforms under the influence of controlled heat to become narrower at crossings of adjacent warp strands and correspondingly bulges between alternate warp strands, (ii) weaving all said strands together to form a fabric sheet, (iii) stretching said fabric sheet, and (iv) heating said fabric sheet to a desired temperature range where said stuffer strands will deform to a greater extent than the other strands of said fabric to reduce the interstitial areas formed by surrounding strands to thereby lower the permeability of the fabric.

The weft strands which exhibit preferential softening may have a lower melting point than the other weft strands of the fabric and are therefore influenced by conductive heating. Or, the said weft strands may be more absorptive of radiant heat and preferentially softened by infra-red radiation.

Normally, the strands selected to be influenced by radiant heat would be blackened by the addition of a blackening agent like, for example, carbon black to render them more absorptive. These blackened strands may be composed of the same basic material as the regular weft of the fabric or any other material provided that in its woven state and heated by infra-red radiation, it begins to soften before the regular weft begins to soften.

In practicing this invention, we have found that it is sometimes useful to weave a larger diameter strand of the heat sensitive material in some of the locations in the weave structure. When these larger strands are preferentially softened they fill the interstices more fully than strands having regular diameter.

The preferred fabric of this invention will have flattened warp as well as at least some weft strands that exhibit preferential softening under the influence of heat.

DESCRIPTION OF DRAWINGS

The invention is illustrated with reference to the accompanying drawings in which:

Referring to FIGS. 1 and 1A there is shown a sectional view of an all monofilament 4-shaft 12 repeat duplex dryer fabric in which numerals 20, 21, 22 and 23 refer to a group of consecutive warp strands which may or may not be flattened or otherwise shaped. In this instance the warp strands are shown as flattened to indicate the preferred condition over which the present invention is an improvement. The group of warp strands is repeated in the weft direction as 20'-23', and so on.

Figure 1:
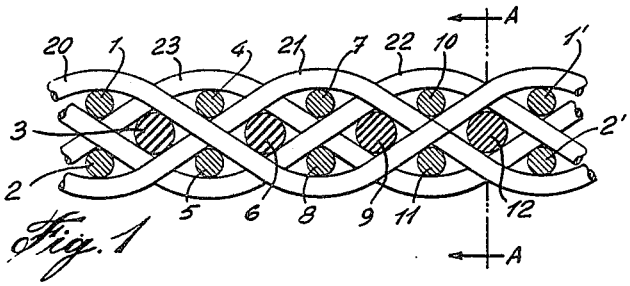
FIG. 1 is an enlarged sectional view of a portion of an all-monofilament duplex weave dryer fabric, in the as-woven condition, according to the present invention.

The weft is paired in two layers and numbered 1 to 12 in a group and repeated in the warp direction as 1' to 12', and so on. Strands 1, 4, 7 and 10 are upper layer weft strands and 2, 5, 8 and 11 lower layer weft strands. Strands 3, 6, 9 and 12 are heat sensitive stuffer strands woven into the mid-plane interstices of the fabric.

In the fabric structure a warp strand 20 passes in order over a first pair of weft strands 1 and 2, over a stuffer strand 3, between a second pair of weft strands 4 and 5, under stuffer strand 6, under a third pair of weft strands 7 and 8, under stuffer strand 9, between a fourth pair of weft strands 10 and 11 and over stuffer strand 12 and then repeats the pattern in the same sequence through the next group of 12 weft strands. The next consecutive warp strand 21 passes under the first pair of weft strands 1 and 2, under stuffer strand 3 between the second pair of weft strands 4 and 5 over stuffer strand 6, over the third pair of weft strands 7 and 8, over stuffer strand 9, between the fourth pair of weft strands 10 and 11 and under stuffer strand 12 before repeating the sequence. The third consecutive warp strand 22 passes between weft strands 1 and 2 under stuffer strand 3, under pair 4 and 5, under stuffer 6, between 7 and 8 over stuffer 9, over pair 10 and 11 and over stuffer 12. The fourth consecutive warp strand 23 passes between wefts 1 and 2, over stuffer 3, pair 4 and 5 and stuffer 6, between wefts 7 and 8 and under stuffer 9, pair 10 and 11 and stuffer 12.

Figure 1A:
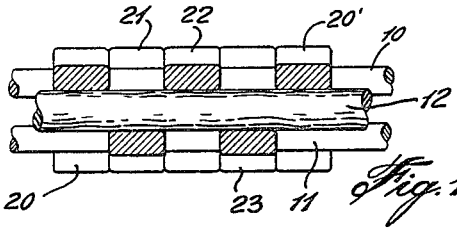
FIG. 1A is a sectional view along section lines A—A of FIG. 1.
Figure 2:
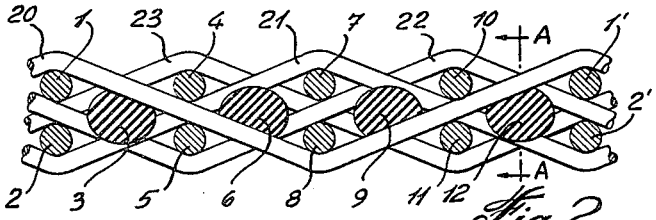
FIG. 2 is an enlarged sectional view of the fabric of FIG. 1 after heat treatment.
Figure 2A:
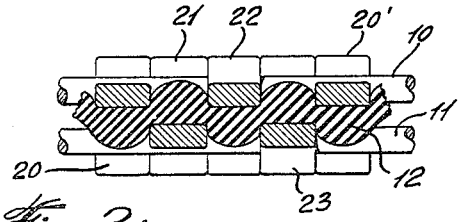
FIG. 2A is a sectional view along section lines A—A of FIG. 2.

FIGS. 1 and 1A depict the fabric in the as-woven condition in which the stuffer strands are substantially round and, as shown at 12 in FIG. 1A, substantially straight. FIGS. 2 and 2A depict the same fabric after heat-setting in the temperature range in which the heat sensitive stuffer strands 3, 6, 9 and 12 have begun to melt. As shown in FIG. 2A the stuffer strands, under the influence of heat and tension on the fabric applied in the warp direction, have tended to flatten out and to fill the interstitial channels into which they have been woven.

As indicated to FIG. 2A, partially melted stuffer strand 12 has been narrowed at the scissors-like crossings of adjacent warp strands 20, 21 and 21, 22 and has correspondingly bulged between alternate warp strands 20, 22 and 21, 23. Although difficult to illustrate by drawings, it can readily be visualized that the partially melted stuffer strand, shown at 12 in FIG. 2A, has become distorted in such a way that it has tended to partially block voids in the fabric mesh and would therefore result in the fabric having reduced air permeability. It will also be apparent that distortion and consequent mesh blockage is dependent upon temperature for a given fabric pattern and heat setting tension.

I claim:

1. A dryer fabric comprising a plurality of interwoven monofilament plastic polymeric warp and weft strands, at least some of said weft strands are stuffer strands formed of a material softened under the influence of controlled heat during a heat-setting treatment, said stuffer strands being selected from a deformable material which is more absorbtive of said controlled heat than are the remainder of said strands, so that said deformable material softens preferentially whereby said material becomes narrower at crossings of adjacent warp strands and correspondingly bulges between alternate warp strands to reduce the spaces in the interstitial areas formed by surrounding strands thereby lowering the permeability of said fabric, said deformable material retaining its solid property during deformation thereof.

2. A dryer fabric as claimed in claim 1 wherein said heat-setting treatment is in the range of about from 350° F. to 430° F. whereby said stuffer strands soften and deform to a greater extent than the other strands of said fabric.

3. A dryer fabric as claimed in claim 2 wherein said stuffer strands are nylons, polybutylene terephthalate or other similar material.

4. A dryer fabric as claimed in claim 1 wherein said stuffer strands are colored strands to improve the absorption of infra-red radiation.

5. A dryer fabric as claimed in claim 4 wherein said stuffer strands are colored with a blackening agent, such as carbon black.

6. A dryer fabric as claimed in claim 1 wherein said warp strands are flattened strands.

7. A dryer fabric as claimed in claim 1 wherein all of said weft strands are stuffer strands.

8. A dryer fabric as claimed in claim 1 wherein said fabric is a duplex fabric, said weft strands being disposed in pairs between said warp strands, each weft strand of each pair extending into a respective upper and lower weft layer, said stuffer strands extending between opposed layers of said weft strands in mid-plane interstices formed between each adjacent pair of weft strands.

9. A dryer fabric as claimed in claim 8 wherein said warp strands are flattened strands.

10. A method of making a dryer fabric having reduced permeability, said fabric having a plurality of warp and weft strands with at least some of said weft strands being stuffer strands, said method comprising the steps of:

(i) selecting said weft stuffer strands from a material that is softened and deforms under the influence of controlled heat, said stuffer strands being selected from a deformable material which is more absorbtive of said controlled heat than are the remainder of said strands, to soften preferentially and to become narrower at crossings of adjacent warp strands and correspondingly bulges between alternate warp strands, said deformable material retaining its solid property during deformation thereof;

(ii) weaving all said strands together to form a fabric sheet;

(iii) stretching said fabric sheet; and (iv) heating said fabric sheet to a desired temperature range where said stuffer strands will deform to a greater extent than the other strands of said fabric to reduce the interstitial areas formed by surrounding strands to thereby lower the permeability of said fabric.

11. A method as claimed in claim 10 wherein said fabric is stretched to a tension up to about 10 lbs. per linear inch of width and heated to a temperature in the range of from about 350° F. to 430° F.

12. A method as claimed in claim 10 wherein step (ii) comprises weaving said strands to form a duplex fabric with said weft strands being disposed in pairs between said warp strands, each weft strand of each pair extending into a respective upper and lower weft layer, said stuffer strands being woven between opposed layers of weft strands in mid-plane interstices formed between each adjacent pair of weft strands.

13. A method as claimed in claim 10 wherein said selected weft strands of step (i) have been colored to improve absorption of infra-red radiation whereby said weft stuffer strands will soften to a greater extent than the other strands of said fabric when subjected to infra-red radiation.

14. A method as claimed in claim 10 wherein said selected weft strands of step (i) are formed of a material having a lower melting point than the other strands of said fabric whereby said weft stuffer strands will soften to a greater extent than the other strands of said fabric when subjected to conductive heat.

15. A method as claimed in claim 13 or 14 wherein said step (iv) comprises subjecting said fabric sheet to ambient heat in the range of from about 350° F. to 430° F.

* * * * *